US010731845B2

(12) United States Patent
Harvey

(10) Patent No.: US 10,731,845 B2
(45) Date of Patent: Aug. 4, 2020

(54) FLASHLIGHT WITH INTEGRATED SELF-DEFENSE DEVICE

(71) Applicant: James Austin Harvey, Garden Grove, CA (US)

(72) Inventor: James Austin Harvey, Garden Grove, CA (US)

( * ) Notice: Subject to any disclaimer, the term of this patent is extended or adjusted under 35 U.S.C. 154(b) by 102 days.

(21) Appl. No.: 15/937,861

(22) Filed: Mar. 28, 2018

(65) Prior Publication Data

US 2019/0301728 A1 Oct. 3, 2019

(51) Int. Cl.

| | |
|---|---|
| ***F21V 33/00*** | (2006.01) |
| ***F21V 5/00*** | (2018.01) |
| ***F21L 4/00*** | (2006.01) |
| ***F21V 31/00*** | (2006.01) |
| ***F41H 9/10*** | (2006.01) |
| ***F21V 7/00*** | (2006.01) |
| *F21Y 115/10* | (2016.01) |

(52) U.S. Cl.

CPC ..... *F21V 33/0076* (2013.01); *F21L 4/005* (2013.01); *F21V 5/006* (2013.01); *F21V 7/0083* (2013.01); *F21V 31/005* (2013.01); *F41H 9/10* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 6,786,368 | B2 * | 9/2004 | Cellini | F41B 15/02 222/175 |
| 7,069,926 | B2 | 7/2006 | Skellern et al. | |
| 2008/0158859 | A1 | 7/2008 | McMeekin et al. | |
| 2015/0048180 | A1 | 2/2015 | Teig | |

* cited by examiner

*Primary Examiner* — Elmito Breval

(74) *Attorney, Agent, or Firm* — Ariel S. Bentolila; Bay Area IP Group, LLC

(57) ABSTRACT

A device having a flashlight and spray implement. The device including a lens part disposed proximate a front portion of the device. A discharge trigger implement is configured to slide longitudinally along with a spray canister to discharge the contents of the spray canister. A discharge arm portion operably slides the spray canister upon a force applied to the discharge trigger implement. A canister access screw implement is configured to pull said spray canister forward, and wherein the canister access screw implement is further configured to allow a removal and replacement of the spray canister. A lens nozzle part engages a center portion of the lens part to allow the contents of the spray canister to shoot out of the center portion of the lens part. A safety button implement is configured to guard against an accidental discharge of the contents of the spray canister.

20 Claims, 4 Drawing Sheets

FLASHLIGHT WITH INTEGRATED SELF-DEFENSE DEVICE

CROSS-REFERENCE TO RELATED APPLICATIONS

Not applicable.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to self-defense devices. More particularly, certain embodiments of the invention relates to flashlights with incorporated self-defense device.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Weapons that can be used for protection, such as pistols, rifles, and other firearms is not always commensurate for self-defense in that the potential for death or serious bodily injury may often far outweigh the level of injury to the user that is threatened. As such, it is apparent that varying levels of non-lethal force alternatives are needed to respond to varying levels of potential danger.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that typical box type pepper spray designs may be bulky and ergonomically uncomfortable to handle and may be awkward to discharge. In addition, conventional tubular pepper spray designs may be comparatively long. Furthermore, long spray tubes may have a tendency to trap and dribble residual pepper spray after the device is discharged. In the same token, typical pistol type pepper spray designs may be dangerous because an unwanted aggressor seeing any type of pistol pointed at him may be inclined to shoot first or escalate aggression in self-defense.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
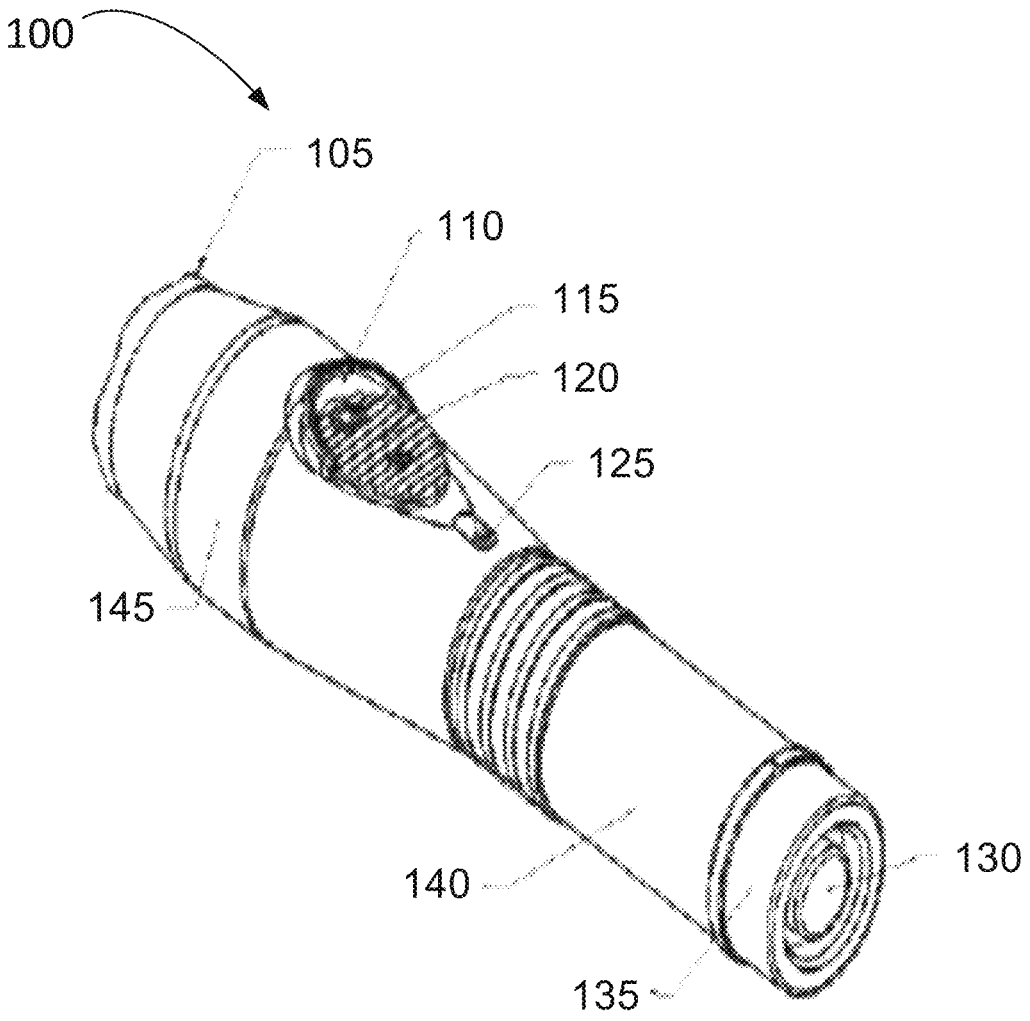
FIG. 1 illustrates a perspective view of an exemplary Self Defense Flashlight device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

FIG. 1 illustrates a perspective view of an exemplary Self Defense Flashlight device 100, in accordance with an embodiment of the present invention. In the present embodiment shown, the Self Defense Flashlight device 100 may include, but not limited to, a Lens Holder 105, a Thumb Barrier 110, a Safety Button 115, a Discharge Trigger 120, a Canister Access Screw 125, a Light Switch Boot 130, a Light Switch Housing 135, a Knurled Handle 140, and a Central Housing 145. In one embodiment, the Safety Button 115 may be into engagement with the Discharge Trigger 120. The spring loaded Safety Button 115 provides a secondary barrier against accidental discharge of the pepper spray. The Safety Button 115 may be depressed by a user to advance the Discharge Trigger 120 forward. This safety feature allows users to confidently carry the Self Defense Flashlight device 100 in a purse, backpack, pant pocket or glove compartment without risking accidental discharge. The Safety Button 115 is configured to position on top of the Discharge Trigger 120 and slightly aft of the Thumb Barrier. The semi-embedded location aft of the Thumb Barrier 110 may serve two purposes, namely to guard against accidental pressure on the Safety Button 115 and to provide non-complicated, user friendly access to the Safety Button 115. No manipulation is needed to access the Safety Button 115 such as opening a hatch or actuating a switch. To discharge this Self Defense Flashlight device, a user may simply push down on the Safety Button 115 while applying forward pressure to the Discharge Trigger 120.

Figure 2:
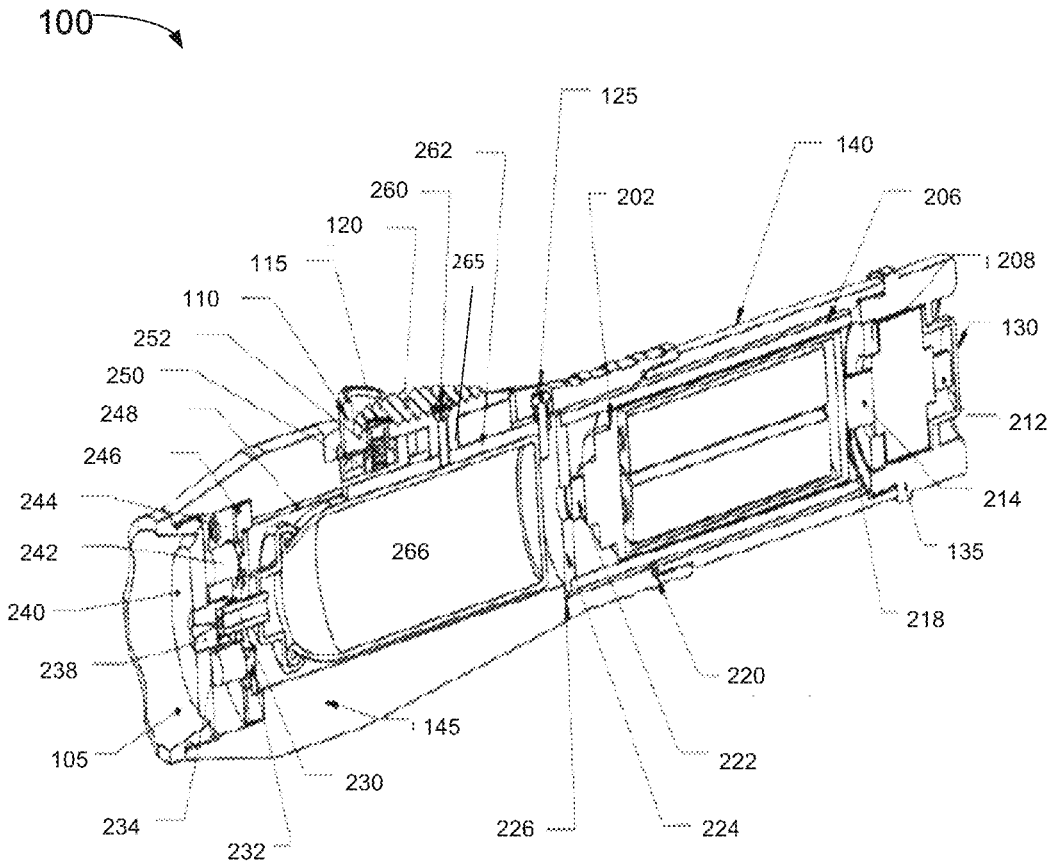
FIG. 2 illustrates a cross-sectional view of the exemplary Self Defense Flashlight device, in accordance with an embodiment of the present invention.

FIG. 2 illustrates a cross-sectional view of the exemplary Self Defense Flashlight device 100, in accordance with an embodiment of the present invention. In the present embodiment shown, the Self Defense Flashlight device 100 may comprise, but not limited to, a combination flashlight and spray implement. The flashlight and spray implement may include, a but not limited to, a Battery Pack 202, a Knurled Handle 140, a Battery Pack Spacer 206, a Light Switch Contact 2 208, a Light Switch Boot 130, a Light Switch Actuator 212, a Light Switch Contact 1 214, a Light Switch Housing 135, a Neg Battery Pack Contact 218, a Neg C-Spring Contact 220, a Pos Battery Pack Contact 222, a Pos Washer Contact 224, a Pos C-Spring Contact 226, a Central Housing 145, a Canister Discharge Tube 230, a LED PCB 232, an O-ring 234, a Lens Holder 105, a Lens Nozzle 238, a Lens 240, a LED Cluster 242, a Mirror 244, a Light Cluster Housing 246, a Discharge Arm Channel 248, a Safety Gate 250, a Safety Spring 252, a Thumb Barrier 110, a Safety Button 115, a Discharge Trigger 120, a Trigger Screw 260, a Trigger Boss 265, a Discharge Arm 262, a Canister Access Screw 125, and a Spray Canister 266. In some embodiments, the flashlight and spray implement 100 is a unitary unit. The flashlight and the spray implement may operate independently. Further, the spray implement may operate independently without the power (Battery Pack 202) supplying the flashlight implement. In addition, the flashlight implement may operate without affecting the functions of the spray implement. In other embodiments, the Canister Access Screw 125 is into engagement with the Discharge Arm 262 and is so configured to serve two purposes, first, to pull the Spray Canister 266 forward to discharge the contents of the Spray Canister 266 and second, to allow a removal and replacement of the Spray Canister 266. The Spray Canister 266 is accessed for removal by unscrewing and separating the Knurled Handle 140 from the Central Housing 145 then unscrewing and withdrawing the Canister Access Screw 125 sufficiently to allow the Spray Canister 266 to be removed and replaced.

In one embodiment, a trigger mechanism of the spray implement is configured to discharge the contents of the Spray Canister 266. In a typical operation, the trigger mechanism may include, but not limited to, the Discharge Trigger 120 that is pushed forward to discharge the contents of the Spray Canister 266. The Discharge Trigger 120 may slide longitudinally along with the Spray Canister 266. In turn, the Spray Canister 266 and the Canister Discharge Tube 230 are pushed into the stationary Lens Nozzle 238 to discharge the contents of the Spray Canister 266. In further embodiments, the Lens Nozzle 238 may be incorporated and/or built into a center portion of the Lens 240 which may allow the contents of the Spray Canister 266 to shoot out of the center portion of the Lens 240 of the device 100.

In other embodiments, the Spray Canister 266 may move back and forth. Having the Spray Canister 266 move back and forth may allow for a parallel "pull" system of discharge and may allow a "throw" needed to open a valve (not shown or labeled) which resides inside of the Spray Canister 266.

It may also enhance "ease of manufacturing." The Discharge Trigger 120 may be connected to the Discharge Arm 262 which has a removable Canister Access Screw 264 near the aft end of the Discharge Arm 262. The force applied by a user to the Discharge Trigger 120 is transferred to the Discharge Arm 262 by a Trigger Screw 260 which passes through the Trigger Boss 265. The force applied to the Discharge Trigger 120 is configured to transfer to the Discharge Arm 262 which operably slides the Discharge Trigger 120 longitudinally along with the spray canister to discharge the contents of the spray canister. The Discharge Arm 262 is held in place against the bottom of the Trigger Boss 265 by the Trigger Screw 260 which threads into the Discharge Arm 262. The Discharge Arm 262 slides back and forth in the Discharge Arm Channel 248 and runs longitudinally in the Central Housing 145. The direction of the force applied to the Discharge Trigger 120 by a user to discharge the Spray Canister 266 is parallel to the force needed to open a canister valve of a Spray Canister 266. Applying force to the back of the Spray Canister 266 to discharge its contents may save space, increase discharge efficiency and may allow the Spray Canister 266 to be moved far forward that may eliminate the need for a long spray nozzle. The Spray Canister 266 may include, but not limited to, pepper spray, mace spray, bug spray, aerosol spray, air spray, etc. The spray canister may include, but not limited to, an "off the shelf" 0.5 ounce pepper spray canister commonly used in key-chain size pepper spray devices currently on the market. The discharge force is applied to the back end portion of the Spray Canister 266.

In some embodiments, the flashlight implement may include a Battery Pack 202 having, but not limited to, a standard rechargeable one piece battery with a diameter that fits inside the Knurled Handle 140 without a need to use the Battery Pack Spacer 206. Positive and negative wires may be held in place against the Central Housing 145 approximately near an aft end of the device by compression from the Pos C-Spring Contact 226 and a Neg C-Spring Contact 220. The C-spring contacts may also provide current flow to the LED PCB 232. The positive and negative wires run forward to the LED PCB 232 through holes in the Central Housing 145. Channels may be used in place of the holes to run the wires depending on the manufacturing method chosen. The Mirror 244 may include a flat mirror surrounding the LED Cluster 242.

In other embodiments, the flashlight implement further includes a Pos Washer Contact 224 that may be pressed into an end portion of the Battery Pack Spacer 206. The Pos Washer Contact 224 may allow current to flow from the Pos Battery Pack Contact 222 to the Pos C-Spring Contact 226. The arrangement generally allows access to the Spray Canister 266 for removal and replacement and provides power to the LED PCB 232.

In additional embodiments, the trigger mechanism may further include the Safety Button 115 coupled to the Discharge Trigger 120 which may provide for smooth, natural and intuitive operation. In further embodiments a Lens Nozzle 238 may be incorporated into the Lens 240. Another embodiment may have the Canister Discharge Tube 230 pressing directly against the Lens 240 eliminating the need for a Lens Nozzle 238. This embodiment may need a small hole passing through the Lens 240 to let the pepper spray pass through and a shallow indentation hole in the aft end of the Lens 240 to centrally locate the front end of the Canister Discharge Tube 230. The Lens 240 may serve two purposes, namely, to act as a cover and also a barrier to push against. Using the Lens 240 to push the Canister Discharge Tube 230 against, may allow positioning the canister far forward to save space, wherein the Spray Canister 266 may be located near the front end of the device 100. In other embodiments, the Mirror 244 surrounding the LED Cluster 242 may comprise of flat mirrors.

In other embodiments, the O-ring 234 may provide a tight seal between the Canister Discharge Tube 230 and the Lens Nozzle 238. The flashlight and spray implements 100 are in line with each other. The flashlight and spray implements shares the same housing. The Spray Canister 266 can be discharged whether the flashlight implement is functioning or not. The Spray Canister 266 is ejected parallel to the Central Housing 145 without affecting the functionality of the flashlight implement. The flashlight can be turned on without the Spray Canister 266. In alternative embodiments, the flashlight implement and the spray implement 100 are dependent. The flashlight implement and the spray implement may be directed at the same target.

Figure 3:
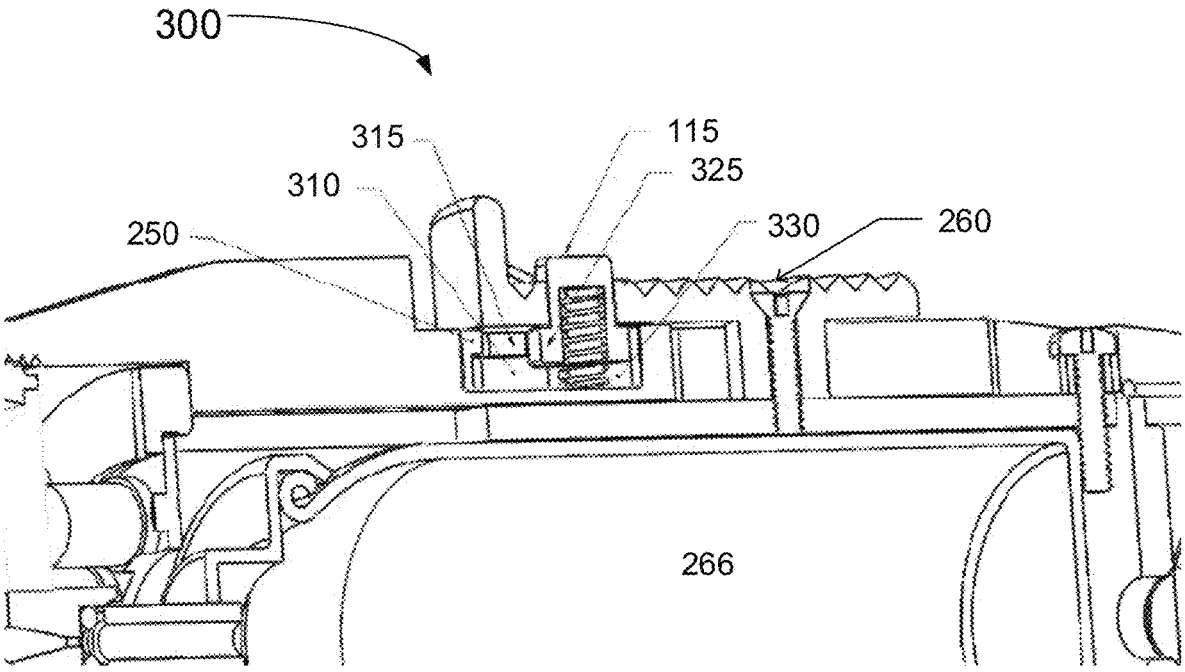
FIG. 3 illustrates a sectional view of an exemplary trigger mechanism of the Self Defense Flashlight device, in accordance with an embodiment of the present invention.

FIG. 3 illustrates a sectional view of an exemplary trigger mechanism 300 of the Self Defense Flashlight device 100, in accordance with an embodiment of the present invention. In the present embodiment shown, the Self Defense Flashlight device 100 may further include, but not limited to, a Safety Gate Insert 250, a Safety Gate Undercut 310, a Button Shoulder Stop 315, a Safety Button 115, a Safety Button Shoulder 325, and a Button Shoulder Clearance Hole 330. In one embodiment, the Safety Button 115 may be incorporated into the Discharge Trigger 120. In the present embodiment shown the Safety Button 115 is spring loaded with a the Safety Spring 252 to push up the Safety Button 115 to protrude above the knurled surface of the Discharge Trigger 120. In this upward position the diameter of the Safety Button Shoulder 325 is engaged into a Button Shoulder Clearance Hole 330 and ceases upward movement when it comes in contact with the bottom of the Discharge Trigger 120. In this upward position the Safety Button Shoulder 325 is trapped behind the Button Shoulder Stop 315 rendering the Discharge Trigger 120 immobile and in a "safe" condition. To discharge the device a user pushes down on the Safety Button 115 sufficiently to cause the Safety Button Shoulder 325 to slide under and clear the Safety Gate 315. The Discharge Trigger 120 can then be pushed forward to discharge the device. In an alternative embodiment, the Discharge Trigger 120 does not incorporate the Safety Button.

In other embodiments, the Central Housing, Knurled Handle, Light Switch Housing, Discharge Trigger may be made of, but not limited to, plastic, aluminum or any other material of sufficient strength which may provide a robust, portable, consumer, industrial or professional grade pepper spray self-defense flashlight. The Canister Access Screw may be elevated slightly off the Discharge Arm by a small bushing. The bushing is configured to provide a "flush" appearance of the screw head with the perimeter of the Central Housing. In another embodiment the bottom of the Discharge Trigger 120 may have a concave or semi-circular shape instead of a flat shape as shown by way of example in FIG. 3. A concave or semi-circular Discharge Trigger 120 bottom may then diametrically mate with and slide longitudinally over a fully circular Central Housing 145. A fully circular Central Housing 145 may save construction material and reduce the overall diameter of the Central Housing 145.

Figure 4:
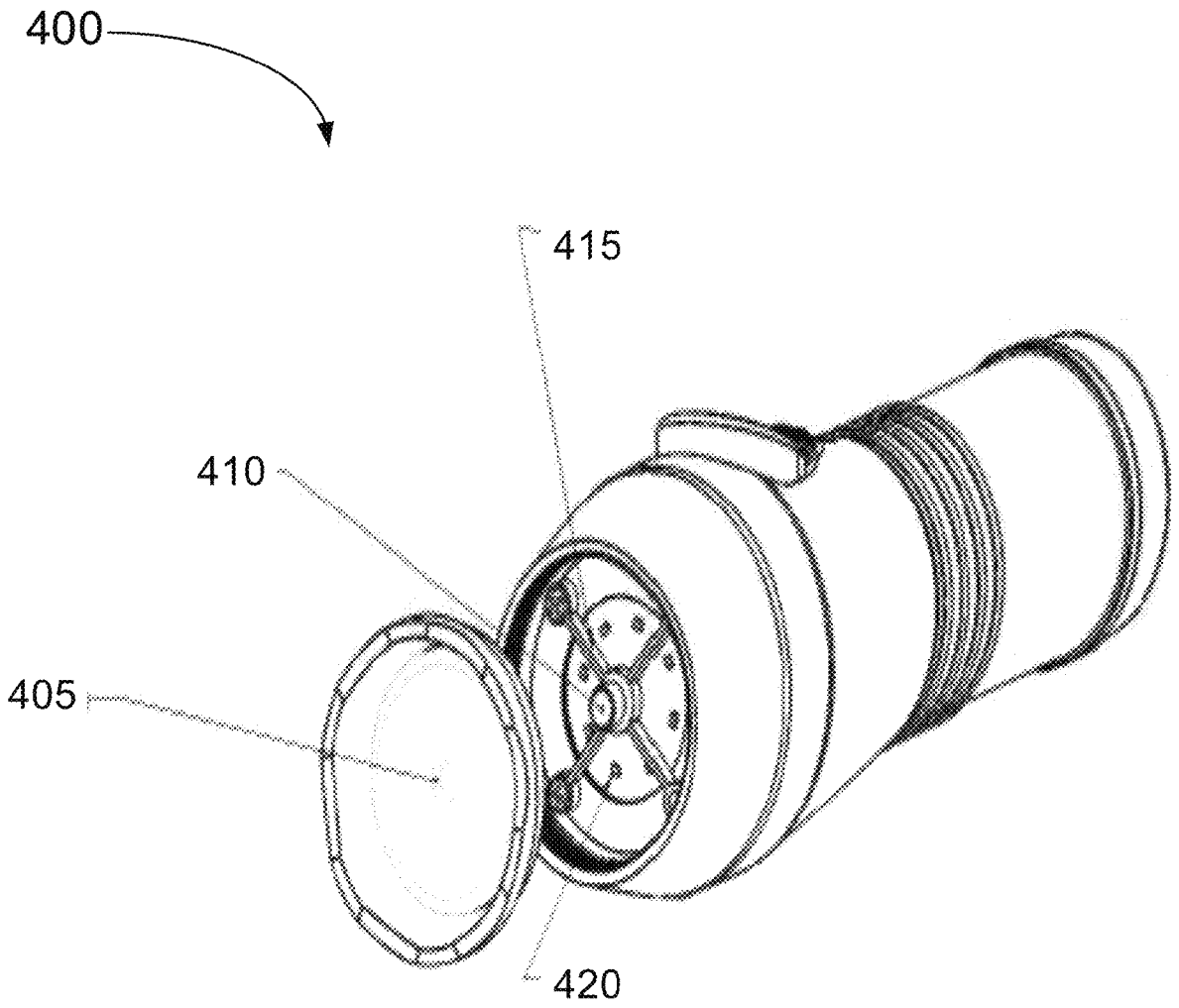
FIG. 4 illustrates a perspective view of an exemplary spray nozzle device of the Self Defense Flashlight device, in accordance with an alternative embodiment of the present invention.

FIG. 4 illustrates a perspective view of an exemplary spray nozzle implement 400 of the Self Defense Flashlight device 100, in accordance with an alternative embodiment of the present invention. In the alternative embodiment shown, the spray nozzle implement 400 may include, but not limited to, a Lens Clearance Hole 405 disposed on a proximate center portion of the lens, an Alt Spray Nozzle 410, an Alt Independent Spray Nozzle Support 415 for providing a support platform for the Alt Spray Nozzle 410, and an Alt LED Flat Lights 420. The Alt Independent Spray Nozzle Support 415 includes a cross arm structure surrounding the Alt Spray Nozzle 410. The Alt Spray Nozzle 410 engages the Lens Clearance Hole 405. The Alt LED Flat Lights 420 may comprise of at least one or more LED flat lights encircling the Alt Spray Nozzle 410. In some embodiments, the Alt Spray Nozzle 410 and Alt Independent Spray Nozzle Support 415 may be configured as a single or unitary piece. When the Discharge Trigger 120 is pushed forward to discharge the contents of the Spray Canister 266, the Discharge Trigger 120 may slide longitudinally along with the Spray Canister 266. In turn, the Spray Canister 266 and the Canister Discharge Tube 230 are pushed into the Alt Spray Nozzle 410 to discharge the contents of the Spray Canister 266. In further embodiments, the Alt Spray Nozzle 410 may be incorporated and/or built into a center portion of the Lens 240 which may allow the contents of the Spray Canister 266 to shoot out of the center portion of the Lens 240 of the device 100.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post MA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing Self Defense Flashlight device, according to the present invention will be apparent to those skilled in the art. Various aspects of the invention have been described above by way of illustration, and the specific embodiments disclosed are not intended to limit the invention to the particular forms disclosed. The particular implementation of the Self Defense Flashlight device 100 having a Discharge Trigger which may slide longitudinally along with the Spray Canister may vary depending upon the particular context or application. By way of example, and not limitation, the Self Defense Flashlight device 100 having a Discharge Arm into engagement with the Discharge Trigger and Canister Access Screw which may pull the Spray Canister forward to discharge the Spray Canister independently from the flashlight implement described in the foregoing were principally directed to, but not limited to, self-defense implementations; however, similar techniques may instead be applied to law enforcement officers, military personnel, etc, which may rely on non-lethal force to properly perform their duties, for example, but not limited to, acts such as dispersing protestors or riotous crowds, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a lens part disposed proximate a front portion of said device to allow light to pass and wherein said lens is further configured to provide structural support to assist opening a valve to a spray canister;

a discharge trigger implement, wherein said discharge trigger implement is configured to slide longitudinally along with said spray canister to discharge the contents of said spray canister;

a discharge arm portion into engagement with said discharge trigger implement, wherein a force applied to said discharge trigger implement is configured to move said discharge arm portion which operably slides a retractable canister access screw implement longitudinally along with said spray canister to discharge the contents of said spray canister;

a canister access screw implement into engagement with said discharge arm, wherein said canister access screw implement is configured to pull said spray canister forward, and wherein said canister access screw implement is further configured to manually retract to allow a removal and replacement of said spray canister;

a lens nozzle part into engagement with a proximate center portion of said lens part, wherein said lens nozzle part is configured to allow the contents of the spray canister to shoot out of said center portion of said lens part, and wherein said lens nozzle is further configured to align canister discharge tube with said center portion of said lens part to allow light to pass around said lens nozzle; and a safety button implement into engagement with said discharge trigger implement, wherein said safety button implement is configured to guard against accidental discharge of the contents of said spray canister, and wherein said safety button implement is further configured to enable an advance of said discharge trigger implement, wherein said safety button implement is further configured to move with said discharge trigger implement.

2. The device of claim 1, in which said spray canister comprises at least one of, a pepper spray, a mace spray, a bug spray, and an aerosol spray.

3. The device of claim 2, further comprising a thumb barrier implement, wherein said thumb barrier implement is configured to guard against accidental pressure on said safety button implement, wherein said thumb barrier implement is further configured to provide a target location to position an operator's thumb, and wherein said thumb barrier implement is further configured to provide a physical barrier for said operator's thumb to push against.

4. The device of claim 3, further comprising a knurled handle portion configured to enclose a battery pack spacer, wherein said knurled handle portion is further configured to enclose a battery pack spacer.

5. The device of claim 4, further comprising a central housing portion configured to enclose said spray canister, wherein said central housing portion is configured to separate from said knurled handle portion to allow a removal and replacement of said spray canister, wherein said central housing portion is further configured to separate from said knurled handle portion to allow removal of said battery pack spacer, and wherein said central housing portion is further configured to allow removal and replacement of said battery pack.

6. The device of claim 5, further comprising a trigger screw tool passing through said central housing portion into engagement with said discharge arm portion.

7. The device of claim 6, further comprising an LED cluster coupled to said battery pack spacer, said battery pack spacer coupled to said battery pack to provide current to the LED cluster.

8. The device of claim 7, further comprising a mirror implement, wherein said mirror implement comprises at least one or more flat mirrors surrounding said LED cluster.

9. The device of claim 1, further comprising a canister discharge tube into engagement with said lens nozzle.

10. The device of claim 9, further comprising an O-ring implement that is configured to provide a tight seal between said canister discharge tube and lens nozzle.

11. The device of claim 1, further comprising a safety button shoulder configured to render said discharge trigger immobile.

12. The device of claim 11, further comprising a button shoulder stop configured to trap said safety button shoulder.

13. The device of claim 12, further comprising a button shoulder clearance hole configured to engage said safety button shoulder.

14. The device of claim 1, further comprising a lens clearance hole disposed on a proximate center portion of said lens part.

15. The device of claim 14, further comprising a lens nozzle support structure configured to provide a support platform for said lens nozzle.

16. The device of claim 15, further comprising an LED lighting implement, in which said LED lighting implement comprises at least one or more LED lights.

17. A device comprising:

means for providing power to said device;

means enclosing said power providing means;

means for enclosing a spray canister;

means for passing light disposed proximate a front portion of said device to allow light to pass and wherein said light passing means is further configured to provide structural support to assist opening a valve of a spray canister;

means for sliding longitudinally along with said spray canister, to discharge a content of said spray canister through means for discharging said content;

means for pulling said spray canister forward to discharge, and wherein said pulling means is further retractable to allow a removal and replacement of said spray canister;

means for transferring a force applied to said sliding means to slide said means for pulling longitudinally along with said spray canister to discharge the content of said spray canister;

means for providing a barrier to movement of the force transferring means, the barrier means preventing accidental movement to force transferring means, the barrier means further providing a target location to position an operator's thumb and to provide a physical barrier for said operator's thumb to push against;

means for shooting contents of said spray canister through center portion of light passing means, and wherein means for shooting contents is further configured to align said discharge means with said center portion of said light passing means to allow light to pass around said discharge means; and means for guarding against accidental discharge of the contents of said spray canister, said guarding means engaging sliding means and configured to move with sliding means.

18. A device comprising:

a lens part disposed proximate a front portion of said device to allow light to pass and wherein said lens is further configured to provide structural support to assist opening a valve of a spray canister;

a discharge trigger implement, wherein said discharge trigger implement is configured to slide longitudinally along with said spray canister to discharge the contents of said spray canister;

a discharge arm portion into engagement with said discharge trigger implement, wherein a force applied to said discharge trigger implement is configured to move said discharge arm portion which operably slides a retractable canister access screw implement longitudinally along with said spray canister to discharge the contents of said spray canister;

a canister access screw implement into engagement with said discharge arm, wherein said canister access screw implement is configured to pull said spray canister forward, and wherein said canister access screw implement is further configured to manually retract to allow a removal and replacement of said spray canister;

a lens nozzle part into engagement with a proximate center portion of said lens part, wherein said lens nozzle part is configured to allow the contents of the spray canister to shoot out of said center portion of said lens part, and wherein said lens nozzle is further configured to align canister discharge tube with said center portion of said lens part to allow light to pass around said lens nozzle;

a safety button implement into engagement with said discharge trigger implement, wherein said safety button implement is configured to guard against accidental discharge of the contents of said spray canister, and wherein said safety button implement is further configured to enable an advance of said discharge trigger implement, wherein said safety button implement is further configured to move with said discharge trigger implement; and a thumb barrier implement, wherein said thumb barrier implement is configured to guard against accidental pressure on said safety button implement, wherein said thumb barrier implement is further configured to provide a target location to position an operator's thumb, and wherein said thumb barrier implement is further configured to provide a physical barrier for said operator's thumb to push against.

19. The device of claim 18, in which said spray canister comprises at least one of, a pepper spray, a mace spray, a bug spray, and an aerosol spray.

20. The device of claim 19, further comprising:

a knurled handle portion, in which said knurled handle portion is configured to enclose a battery pack for providing power to said device, said battery pack being coupled to an LED cluster surrounding said lens nozzle, the battery pack providing current to said LED cluster;

a central housing portion, wherein said central housing portion is configured to enclose said spray canister; and wherein said central housing portion is configured to separate from said knurled handle spray canister to operably allow a removal and replacement of said spray canister.

* * * * *